US006104905A

United States Patent [19]

Kondo et al.

[11] Patent Number: 6,104,905

[45] Date of Patent: Aug. 15, 2000

[54] IMAGE FORMING APPARATUS OF INTERMEDIATE TRANSFER TYPE

[75] Inventors: Akihiro Kondo; Teruyuki Miyamoto, both of Osaka, Japan

[73] Assignee: Mita Industrial Co., Ltd., Osaka, Japan

[21] Appl. No.: 09/286,836

[22] Filed: Apr. 6, 1999

[30] Foreign Application Priority Data

Apr. 23, 1998 [JP] Japan ..... 10-113014

[51] Int. Cl.[7] ..... G03G 15/01

[52] U.S. Cl. ..... 399/302; 399/308

[58] Field of Search ..... 399/302, 308, 399/303, 312, 313

[56] References Cited

FOREIGN PATENT DOCUMENTS 10-39550 2/1998 Japan .

*Primary Examiner*—Arthur T. Grimley
*Assistant Examiner*—Quana Grainger
*Attorney, Agent, or Firm*—Smith, Gambrell & Russell, LLP

[57] ABSTRACT

An image forming apparatus having a developing mechanism for successively forming a plurality of color toner images on a photoreceptor; and an intermediate transfer member on which the plurality of color toner images are transferred from the photoreceptor in a superposed manner for primary transfer and from which the plurality of color toner images superposedly transferred thereon are transferred to a transfer sheet for secondary transfer. A circumferential ratio between the photoreceptor and the intermediate transfer member is 1:N (N is a non-integer).

5 Claims, 2 Drawing Sheets

IMAGE FORMING APPARATUS OF INTERMEDIATE TRANSFER TYPE

This application claims priority benefits under 35 USC Section 119 on the basis of Japanese Patent Application No. 10-113014 filed to the Japanese Patent Office on Apr. 23, 1998, the disclosure thereof being incorporated herein by reference.

BACKGROUND OF THE INVENTION

1. Field of the Invention

The present invention relates to an image forming apparatus such as a printer, a facsimile machine or a copying machine which is adapted to form a color image on a transfer sheet such as a paper sheet or a plastic sheet and, more particularly, to an image forming apparatus of intermediate transfer type.

2. Description of Related Art

Image forming apparatuses of intermediate transfer type generally include a plurality of developing devices which are provided around a rotating photoreceptor and respectively use color toners. The respective developing devices independently form color toner images on the photoreceptor. The plural color toner images thus formed are successively transferred onto a rotating intermediate transfer member in a superposed manner for formation of a primary transfer image. Then, the color image thus formed on the intermediate transfer member is secondarily transferred onto a transfer sheet transported by a sheet feeding mechanism and the like.

The intermediate transfer member is in a belt form or in a drum form. The circumferential dimension of the intermediate transfer member is properly determined in accordance with the size of a transfer sheet (e.g., a copy sheet of A4-size, A3-size, etc.) to be used. The circumferential dimension of the photoreceptor is determined in accordance with the circumferential dimension of the intermediate transfer member.

In conventionally known image forming apparatuses of intermediate transfer type, a circumferential ratio between the photoreceptor and the intermediate transfer member is generally set at 1:N' (N' is an integer), e.g., 1:1. This leads to a reduced design flexibility and an increased overall size because a sufficient space should be provided for accommodation of the photoreceptor.

SUMMARY OF THE INVENTION

It is an object of the present invention to provide an image forming apparatus which is imparted with an enhanced design flexibility and a reduced size by giving consideration to the circumferential ratio of a photoreceptor to an intermediate transfer member.

In accordance with the present invention, there is provided an image forming apparatus of intermediate transfer type which comprises a plurality of color developing devices disposed around a photoreceptor and are adapted to transfer toner images successively formed on the photoreceptor onto a unidirectionally rotating intermediate transfer member in a superposed manner for primary transfer and then transfer the resulting color toner image from the intermediate transfer member onto a transfer sheet for secondary transfer, wherein a circumferential ratio between the photoreceptor and the intermediate transfer member is 1:N (wherein N is a non-integer).

With this arrangement, the circumferential ratio between the photoreceptor and the intermediate transfer member can properly be set, for example, at 1:1.5, in accordance with design criteria. This allows for size reduction of the image forming apparatus, and enhances flexibility in the design and layout of the components of the image forming apparatus.

It is preferred that the circumferential ratio between the photoreceptor and the intermediate transfer member is 1:N (wherein N is a non-integer) within a range between 1:1 and 1:3.

The foregoing and other objects, features and effects of the present invention will become more apparent from the following description of the preferred embodiments with reference to the attached drawings.

DESCRIPTION OF THE PREFERRED EMBODIMENTS

Figure 1:
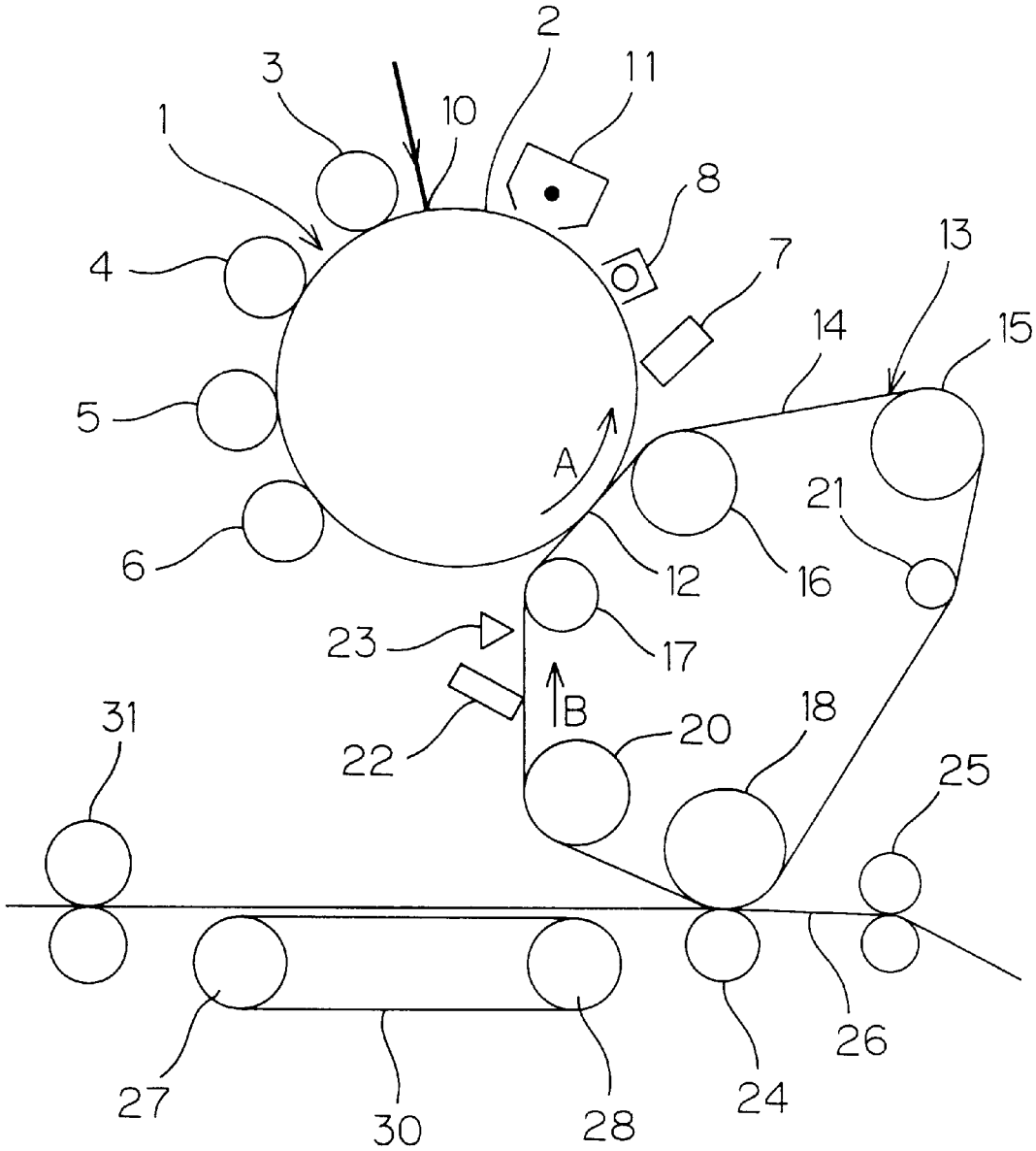
FIG. 1 is a schematic diagram illustrating the construction of an image forming apparatus according to one embodiment of the present invention.

FIG. 1 is a schematic diagram illustrating the construction of an image forming apparatus 1 of intermediate transfer type according to an embodiment of the present invention. In this figure, a plurality of developing devices 3, 4, 5, 6 (developing mechanism) which respectively use black, magenta, cyan and yellow color toners are properly disposed around a photoreceptor drum 2. A cleaning device 7 for cleaning the photoreceptor drum 2 for removal of residual toner is disposed downstream of the developing device 6 (as seen in the rotational direction of the photoreceptor 2). A charge removal lamp 8 is disposed downstream of the cleaning device 7, and a charging device 11 for charging the surface of the photoreceptor 2 is disposed downstream of the charge removal lamp 8 and upstream of a light exposure position 10. The photoreceptor 2 is connected to a motor not shown so as to be smoothly rotated in the direction of an arrow A by the motor.

An intermediate transfer member 13 which forms a nip 12 in contact with the photoreceptor 2 includes an endless transfer belt 14 having a polyurethane base coated with a fluoro-resin. The endless belt 14 is entrained around a driving roller 15, an upper primary transfer roller 16, a lower primary transfer roller 17, an upper secondary transfer roller 18, and tension rollers 20, 21, and adapted to be rotated in the direction of an arrow B by the driving roller 15. The driving roller 15 is driven by a motor (not shown) provided separately from the photoreceptor driving motor. A belt cleaning device 22 is provided adjacent the tension roller 20. A belt position detecting sensor 23 is disposed between the lower primary transfer roller 17 and the belt cleaning device 22.

A lower secondary transfer roller 24 is disposed in association with the upper secondary transfer roller 18. A transfer sheet 26 fed by a registration roller pair 25 and the transfer belt 14 of the intermediate transfer member 13 is pressedly held between the lower secondary transfer roller 24 and the upper secondary transfer roller 18.

A transfer sheet transportation belt 30 stretched between a driving roller 27 and a driven roller 28 is disposed downstream of the lower secondary transfer roller 24 as seen in a transfer sheet transportation direction, so that the transfer sheet 26 having subjected to secondary transfer is transported downstream in the transfer sheet transportation direction.

A fixing device 31 is disposed downstream of the transfer sheet transportation belt 30 as seen in the transfer sheet transportation direction, which is adapted to heat and press the transfer sheet 26 carrying a color toner image transferred thereon for fixation of the color toner image on the transfer sheet 26.

The circumferential dimension of the transfer belt 14 of the intermediate transfer member 13 is determined in accordance with the transfer sheet 26, and the circumferential dimension of the photoreceptor 2 is determined in accordance with the circumferential dimension of the transfer belt 14. More specifically, a circumferential ratio between the photoreceptor 2 and the transfer belt 14 is set at 1:N (N is a non-integer) within a range between 1:1 and 1:3.

According to this embodiment with this arrangement, a first toner image (e.g., a black toner image) is formed on the circumferential surface of the photoreceptor 2 by the first developing device 3, and then transferred onto the circumferential surface of the transfer belt 14 of the intermediate transfer member 13. Upon completion of the transfer of the first toner image, the photoreceptor 2 is cleaned by the cleaning device 7. Thereafter, the charge removal lamp 8 removes charges from the surface of the photoreceptor 2, which is then charged by the charging device 11. After the charged surface of the photoreceptor 2 is exposed to light, a second toner image (e.g., a magenta toner image) is formed on the photoreceptor 2 by the second developing device 4. Then, the second toner image is transferred from the photoreceptor 2 onto the transfer belt 14 of the intermediate transfer member 13 so as to be superposed on the first toner image. Likewise, third and fourth toner images (e.g., cyan and yellow toner images) are formed on the photoreceptor 2 by the third and fourth developing devices 5 and 6, and then successively transferred onto the transfer belt 14.

Thus, the first to fourth toner images are successively transferred onto the transfer belt 14 in a superposed manner, whereby a desired color image is formed on the transfer belt 14. After the primary transfer is thus completed, the resulting color image is transferred onto a transfer sheet 26 by the upper secondary transfer roller 18 and the lower secondary transfer roller 24. Upon completion of the secondary transfer, the transfer sheet 26 carrying the color image transferred thereon is guided to the fixing device 31 by the transfer sheet transporting belt 30, so that the color image is fixed on the transfer sheet 26 by the fixing device 31. On the other hand, residual toner is removed from the transfer belt 14 by the belt cleaning device 22 upon the completion of the secondary transfer for preparation to the next transfer operation.

In accordance with the embodiment, the circumferential ratio between the photoreceptor 2 and the transfer belt 14 is set at 1:N (N is a non-integer) within a range between 1:1 and 1:3, as described above. Therefore, the size of the photoreceptor 2 can be reduced with respect to the intermediate transfer member 13. In addition, the design flexibility is enhanced for the size reduction of the photoreceptor 2, thereby making it easy to design the layout of the components of the image forming apparatus 1.

Figure 2:
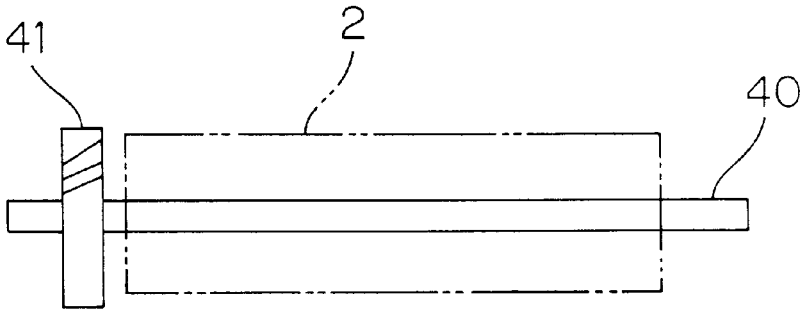
FIG. 2 is a diagram illustrating a support shaft of a photoreceptor according to the embodiment.

FIG. 2 is a diagram illustrating a support shaft 40 of the photoreceptor 2 according to the embodiment. The support shaft 40 is coupled to the external driving motor (not shown) via a gear 41, and opposite ends thereof are rotatably supported by a main body (not shown) of the image forming apparatus via bearings (not shown). The photoreceptor drum 2 is fitted around the support shaft 40.

The gear 41 has been fabricated by press-fitting a gear blank around one end portion of the support shaft 40 and then machining the gear blank in exact coaxial relation with the support shaft 40 with a high degree of precision (with a precision higher than the JIS Level 3). Consideration is thus given to enhancement of the precision of the rotation of the photoreceptor 2. The enhancement of the rotation precision of the photoreceptor 2 increases the precision of the primary transfer, so that color misregistration can effectively be suppressed. This makes it possible to set the circumferential ratio between the photoreceptor 2 and the intermediate transfer member 13 (transfer belt 14) at 1:N (N is a non-integer).

In the prior art, the circumferential ratio between the photoreceptor 2 and the intermediate transfer member 13 is set at 1:N' (N' is an integer). This is because, if the circumferential ratio between the photoreceptor 2 and the intermediate transfer member 13 is set at 1:N (N is a non-integer), the precision of the primary transfer is reduced to readily cause color misregistration. In this embodiment, however, the rotation precision of the photoreceptor 2 is improved simply by employing the power transmission gear 41 which has been fabricated by machining the gear blank after it has been press-fitted around the support shaft 40 in exact coaxial relation with the support shaft 40 with a high precision. Accordingly, the primary transfer can be carried out with a higher precision, making it possible to set the circumferential ratio between the photoreceptor 2 and the intermediate transfer member 13 at 1:N (N is a non-integer).

In this embodiment, the circumferential ratio between the photoreceptor 2 and the intermediate transfer member 13 is set at 1:N (N is a non-integer) within the range between 1:1 and 1:3 for the size reduction of the photoreceptor 2 and the entire image forming apparatus 1 and for easy designing of the layout of the components of the image forming apparatus 1. The selection of a lower limit of 1:1 is based on the requirement that the size of the photoreceptor 2 should be reduced with respect to the intermediate transfer member 13. The selection of an upper limit of 1:3 is based on the fact that a circumferential ratio of 1:3 is considered to be a limit to the size reduction of the photoreceptor 2 in consideration of the requirement that the plurality of imaging devices 3 to 6 should be provided around the photoreceptor 2.

In this embodiment, the photoreceptor drum 2 is employed, but a photoreceptor belt may be employed instead. Further, the intermediate transfer member 13 is in a belt form, but may be in a drum form.

Figure 3:
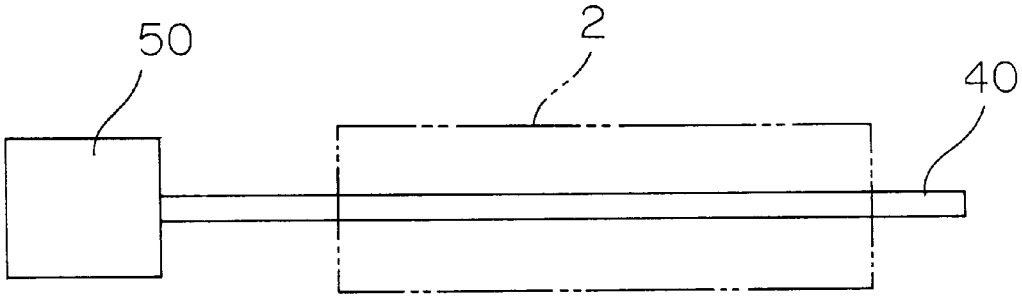
FIG. 3 is a diagram illustrating one exemplary color misregistration preventing mechanism.

FIG. 3 illustrates another arrangement which improves the rotation precision of the photoreceptor 2 to make it possible to set the circumferential ratio between the photoreceptor 2 and the intermediate transfer member 13 at 1:N (N is a non-integer). In this arrangement, an output shaft of a motor 50 serves as the support shaft 40 of the photoreceptor 2, so that the photoreceptor 2 is rotated directly by the motor. Thus, smooth rotation of the photoreceptor 2 is ensured, whereby the primary transfer can be carried out with a further improved precision to effectively suppress the color misregistration. Therefore, the size reduction of the image forming apparatus 1 can be achieved and, at the same time, higher-quality image formation can be ensured.

Since the circumferential ratio between the photoreceptor 2 and the intermediate transfer member 13 is set at 1:N (N is a non-integer) and the color misregistration preventing mechanism is provided for improvement of the rotation precision of the photoreceptor 2, the image forming apparatus 1 is imparted with an enhanced design flexibility and a smaller size and is capable of higher-quality image formation.

While the present invention has been described in detail by way of the embodiments thereof, it should be understood that the foregoing disclosure is merely illustrative of the technical principles of the present invention but not limitative of the same. The spirit and scope of the present invention are to be limited only by the appended claims.

What is claimed is:

1. An image forming apparatus, comprising:

a photoreceptor having a circumferential surface on which a toner image is formed, and adapted to be rotated in a predetermined direction;

a developing mechanism provided around the photoreceptor, and adapted to successively form a plurality of color toner images on the photoreceptor; and an intermediate transfer member having a circumferential surface on which the plurality of color toner images are transferred from the photoreceptor in a superposed manner for primary transfer and from which the plurality of color toner images superposedly transferred thereon are further transferred onto a transfer sheet for secondary transfer;

wherein a circumferential ratio between the photoreceptor and the intermediate transfer member is 1:N, wherein N is a non-integer.

2. An image forming apparatus as set forth in claim 1, wherein the circumferential ratio between the photoreceptor and the intermediate transfer member is 1:N, wherein N is a non-integer within a range between 1:1 and 1:3.

3. An image forming apparatus as set forth in claim 1, further comprising a color misregistration preventing mechanism for preventing color misregistration of the plurality of color toner images by stabilizing the rotation of the photoreceptor.

4. An image forming apparatus as set forth in claim 3, wherein the photoreceptor is in a drum form;

wherein the color misregistration preventing mechanism includes a gear fixed to a support shaft which serves as a rotation axis of the photoreceptor, the gear having been fabricated by fixing a gear blank to the support shaft and then machining the gear blank in exact coaxial relation with the support shaft.

5. An image forming apparatus as set forth in claim 3, wherein the photoreceptor is in a drum form;

wherein the color misregistration preventing mechanism includes an output shaft of a motor for rotatively driving the photoreceptor, the output shaft serving as a support shaft of the photoreceptor as a rotation axis thereof.

* * * * *